US007044302B2

(12) United States Patent
Conley

(10) Patent No.: US 7,044,302 B2
(45) Date of Patent: May 16, 2006

(54) PATIENT CONTROLLED TIMED ORAL MEDICATION DISPENSER

(75) Inventor: N. Sharon Conley, Ormond Beach, FL (US)

(73) Assignee: Avancen, Inc., Ormond Beach, FL (US)

( * ) Notice: Subject to any disclaimer, the term of this patent is extended or adjusted under 35 U.S.C. 154(b) by 456 days.

(21) Appl. No.: 10/247,427

(22) Filed: Sep. 19, 2002

(65) Prior Publication Data

US 2003/0052135 A1 Mar. 20, 2003

Related U.S. Application Data

(60) Provisional application No. 60/323,521, filed on Sep. 19, 2001.

(51) Int. Cl.
*B65D 83/04* (2006.01)

(52) U.S. Cl. ..... 206/538; 206/807

(58) Field of Classification Search ..... 221/2, 221/9, 15; 206/536, 538, 528, 807, 828
See application file for complete search history.

(56) References Cited

U.S. PATENT DOCUMENTS 4,572,403 A 2/1986 Benaroya
4,811,764 A * 3/1989 McLaughlin ..... 141/98
4,962,491 A 10/1990 Schaeffer
5,246,136 A 9/1993 Loidl
5,472,113 A * 12/1995 Shaw ..... 221/7
5,522,525 A * 6/1996 McLaughlin et al. ..... 221/4
5,850,937 A 12/1998 Rauche
6,021,918 A 2/2000 Dumont et al.
6,138,865 A * 10/2000 Gilmore ..... 221/2
6,145,697 A * 11/2000 Gudish ..... 221/3
6,163,736 A 12/2000 Halfacre
6,194,995 B1 2/2001 Gates
6,216,910 B1 4/2001 Numerick
6,219,587 B1 4/2001 Ahlin et al.
6,221,010 B1 4/2001 Lucas
6,234,343 B1 5/2001 Papp
6,415,202 B1 * 7/2002 Halfacre ..... 700/232
6,529,446 B1 * 3/2003 de la Huerga ..... 368/10
6,766,219 B1 * 7/2004 Hasey ..... 700/242

* cited by examiner

*Primary Examiner*—Jacob K. Ackun, Jr.
(74) *Attorney, Agent, or Firm*—John L. DeAngelis, Jr.; Beusse Brownlee Wolter Mora & Maire, P.A.

(57) ABSTRACT

The oral medication delivery device provides patient access to medications prescribed to be available on an as-needed basis, but with a minimum time intervals between doses. The required time interval between drug accessibility is programmed into the device when the medication tray carrying the multiple doses is loaded into the device. The device allows access to a single dose of the medication after each minimum time interval has elapsed. When the drug dose is removed from the device, the medication tray locks until the next minimum time interval has elapsed.

17 Claims, 5 Drawing Sheets

PATIENT CONTROLLED TIMED ORAL MEDICATION DISPENSER

CROSS-REFERENCE TO RELATED APPLICATIONS

This patent application claims the benefit of the provisional patent application No. 60/323,521 filed on Sep. 19, 2001.

FIELD OF THE INVENTION

The present invention relates generally to an oral medication dispenser, and more particularly to a time controlled oral medication dispenser.

BACKGROUND OF THE INVENTION

Fifty percent of postoperative patients report inadequate pain relief. Fifty percent of all cancer patients and ninety percent of advanced cancer patients experience pain. Pain is now defined as "the fifth vital sign" as part of the mandate by the Joint Commission on Accreditation of Healthcare Organizations (JCAHO) to develop guidelines for pain management.

Adequate pain control requires the appropriate medication for the pain level and type reported. In a hospital setting, pain medication can be obtained only by a physician's order. Pain medications such as narcotics and nonsteroidals (and anxiety medications such as tranquilizers) are frequently ordered on an as-needed basis (referred to as prn orders). This approach requires the patient to initiate a request for each prn drug dose. The nurse then verifies that the appropriate time interval has passed between doses, according to the physician's order. If the required time interval has elapsed, the nurse transports the medication to the patient's bedside and administers the medication to the patient. In some dosing regimens the patient is given a time release pain medication at the same time(s) each day with as-needed (prn) medications for breakthrough pain. Again the patient must request the medication for each breakthrough pain episode. A common reported patient frustration is the need to issue a request for each and every dose of prn medication. Thus a busy nurse must locate the medication and transport it to the patient in response to each request. This must also be accomplished in a timely fashion as patients in pain must be administered to as soon as possible.

The as-needed approach to dosing provides the minimum amount of medication to adequately control symptoms, without the risk of abuse, overdosing and unnecessary side effects. Disadvantageously, in a hospital or institutional setting each medication that is dispensed on a prn basis requires nursing staff time and extra documentation by nursing and pharmacy staff, since the drugs can be administered only after the lapse of the predetermined time interval between doses. For example, a drug prescribed as needed every six hours may be given no more than four times in 24 hours. Such a drug may be administered from zero to four times in any given 24 hour period, depending upon patient dosage requests. If six hours have passed since the last administration of the drug, the medication is provided to the patient in response to the request. If six hours have not lapsed, the patient must wait the minimum time interval of six hours prior to receiving the next drug dose. In a home setting, the patient must remain aware of the restricted dosing schedule to safely self-administer these medications.

An automated bedside dispensing cabinet, requiring the nurse to enter the cabinet at times to dispense medications, is known. As with all prn medications this device requires the nurse visit the patient's room. The medication is removed from the cabinet for dispensing. Although such a device reduces medication errors compared to the conventional approach, it expends valuable nursing time and expense.

It is also known that oral medications may be provided through the use of a sealed wrist pouch. The pouch is worn by the patient and filled with two medication doses. The pouch is refilled by a nurse at the patient's request. The patient reports the time of each self-administered dose and maintains a pain control diary. As in the other prior art devices, nursing staff time is required for refills and nursing staff availability may disrupt timely refilling of the pouch.

Drug delivery devices are known that remind the patient to take a medication at preset time intervals. These devices provide the reminder through a variety of signaling indicators, such as audible alarms, and promote compliance to a scheduled dosing regimen, but do not control nor prevent patient access to the medications at intervals shorter than prescribed.

Known PCA (patient controlled analgesia) intravenous pumps allow patients to self-medicate with pain medications. Using a PCA pump, under a physician's order, a patient receives a single dose of intravenous medication by activating a bedside button. The actuation starts a pump that delivers a measured dose of the intravenous drug (a narcotic, for example) at allowable time intervals. If the button is activated during a time interval in which an allowable dose has already been administered, the pump is "locked out" and unable to deliver the dose until the appropriate time interval has passed. This prevents the patient from taking more than a maximum allowable dose of medication during a measured time interval. The PCA device records the drug volume delivered over time. A nurse can query the device to chart the volume of drug delivered over a given time interval and the number of doses administered.

Two other dosing devices are available using the same principal as the intravenous PCA. These include pumps that deliver narcotic medications subcutaneously and epidural catheters that deliver pain medications near the spinal canal. Cancer patients experiencing both acute and chronic pain use such intravenous PCA pumps.

A randomized study of pain management in a post-operative setting using patient controlled analgesia (that is, the PCA pump) versus conventional pain therapy (CPT) (i.e., a request to the nurse for each administered dose), has been reported in the medical literature. Patient satisfaction for pain management in the PCA group was significantly better than that reported in the CPT group. Note, the only difference between the two study groups was the ability of the PCA group to easily and promptly self-control the medication dosing.

Multiple factors prevent the timely dosing of pain and other as needed medications to the patient bedside according to conventional pain therapy techniques. A national survey of pharmacy practice in acute care settings in 1999 indicated that 75% of pharmacies still practice centralized pharmacy distribution systems. In some situations, these centralized pharmacies extend the time required to deliver medications to each patient area. A future trend will be automated medication dispensing stations in each patient area. Although this is a trend for the future, it is not as yet reality except in large, sophisticated, primarily academic hospitals. Currently there is a shortage of pharmacists and the existing staffs are over-burdened, creating further delays in drug delivery to the patient bedside.

In about 98% of the cases, nurses directly administer medications to patients. A time and motion study has reported that each prn oral medication delivered by a nurse to a hospital patient requires 18.42 minutes, which includes the unlocking of the narcotics cabinet to sign out the medication, transporting it to the patient's bedside, and documenting (charting) the time the dose is given. Like the pharmacy staff, nursing staffs are short-handed, while the number of complex hospitalized patients is growing. These patients have increasingly more complex diagnoses with more medication requirements.

Improved patient pain control leads to better patient outcomes in the hospital setting. This has been well documented in the surgical literature in the postoperative setting, with fewer postoperative complications, earlier rehabilitation, and shorter hospital stays in patients with better pain management. Better pain management is also highly cost effective since earlier discharges and few complications save dollars and staff time.

BRIEF SUMMARY OF THE INVENTION

The medication on demand device of the present invention offers controlled self-medication by the patient and thus promotes patient autonomy by allowing access to the medications on an as-needed basis. However, a second dose can be delivered only after a required minimum time has elapsed from a first dose. The device includes a timing mechanism that permits patient access to the next dose only after a specified dosing interval as prescribed by a physician's order. Once the dosing interval has elapsed, access to the next medication dose is provided using a unique keypad-operated entry code entered by the patient.

When used in a facility setting, this device promotes patient autonomy and a more efficient drug delivery process, without the delay associated with nursing delivery of the drug and the attendant nursing staff record-keeping. Thus the amount of time consumed by nursing and pharmacy staff to deliver and document each drug dose is reduced. However, the nursing staff is able to chart the time at which doses were administered from time data recorded on the device. Since the medications are loaded into the device of the present invention in a cassette carrying multiple doses, the pharmacy can deliver multiple doses as one item, thus also reducing the drug handling and inventory requirements of the pharmacy.

The device of the present invention can be used for any application of oral pain management in a hospital, nursing home, hospice or assisted living facility. In addition to patients suffering chronic pain, many postoperative and trauma patients, as well as patients in rehabilitative facilities, require as-needed oral pain medication and thus can benefit from use of the present device. In a home setting where dosing intervals are patient-monitored, use of the medication on demand device of the present invention avoids overdosing and relieves the patient of the need to monitor the time between drug doses, since the device permits access only after the ordered minimum time has elapsed. Although reference is made to the delivery of pain medication using the device of the present invention, the device can also deliver other drugs, such as tranquilizers and anti-nausea medications, or any other drugs that are administered on a prn basis.

The medication dispensing device can interface, through a suitable network, with an automated drug dispensing, inventory, and billing system. This application allows the device to function as a "mini satellite" at the patient's bedside, as one element of a larger automated pharmacy system located in each patient area.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The figures are not necessarily to scale, emphasis instead being placed upon illustrating the principles of the invention.

DETAILED DESCRIPTION OF THE INVENTION

Figure 1:
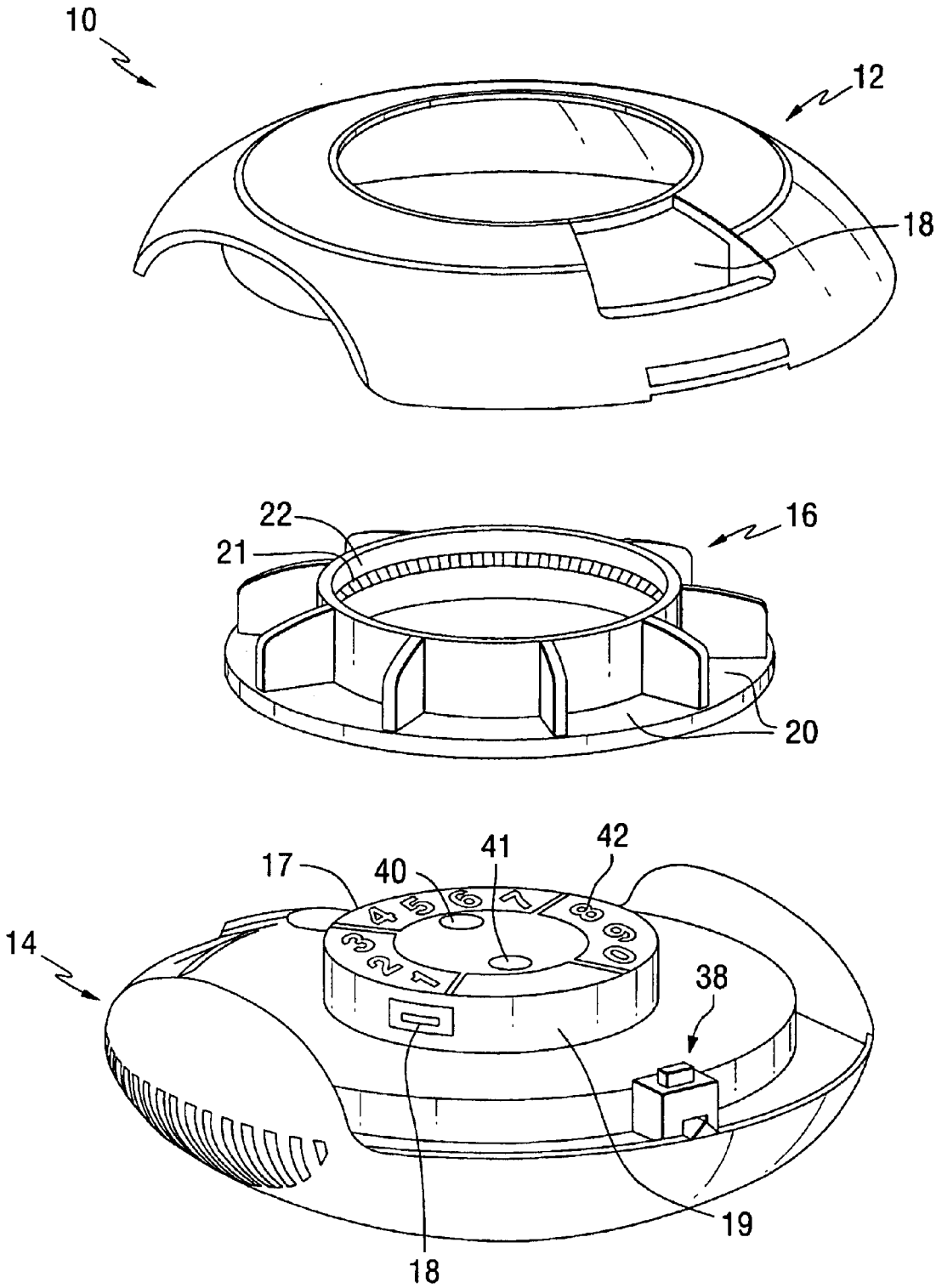
FIG. 1 is an exploded view of a medication on demand device constructed according to the teachings of the present invention.

Before describing in detail the particular medication dispenser in accordance with the present invention, it should be observed that the present invention resides primarily in a novel combination of hardware and software elements related to a medication dispenser. Accordingly, the elements have been represented by conventional elements in the drawings, showing only those specific details that are pertinent to the present invention, so as not to obscure the disclosure with structural details that will be readily apparent to those skilled in the art having the benefit of the description herein.

A medication on demand device 10 constructed according to the teachings of the present invention is illustrated in the exploded view of FIG. 1, comprising an upper assembly 12 for mating with a lower assembly 14 and capturing a medication tray 16 there between. The medication tray 16 is received by an upper surface enclosure 17 of the lower assembly 14. In one embodiment a motor (not shown in FIG. 1) is located within the upper surface enclosure 17. A gear 18 attached to the motor shaft protrudes from the vertical surface 19 of the upper surface enclosure 17 for drivingly mating with a circumferential gear track 21 disposed on an inner surface 22 of the medication tray 16. Thus rotation of the gear in response to the application of electricity to the motor causes rotation of the medication tray 16.

The upper assembly 12 includes a passage 18 for receiving a door (not shown in FIG. 1) providing access to one of a plurality of medication compartments 20 of the medication tray 16. Once the patient has opened and closed the door to remove the medication, a timing sequence is initiated and during that sequence the medication tray 16 is locked in place. After the interval has elapsed, the medication tray 16 is rotated, through action of the motor and associated gearing, through an arc segment to align the passage 18 with the next one of the plurality of medication compartments 20. As described further below, the medication tray 16 is signalled to rotate via entry of a patient code on a keypad of the device 10. The patient can then remove the next dosage for self-administration.

In the embodiment of FIG. 1 each one of the plurality of equally-sized medication compartments 20 carries a medication dose for administration to the patient. Preferably, the upper assembly 12 is translucent or transparent and the lower assembly 14 is opaque to provide a color contrast, making the medication easily visible within the plurality of medication compartments 20. In another embodiment a color-coded medication tray serves as an indicator of the drug type carried there within. In the pharmacy, the medication tray 16 can be loaded with medications, labeled to identify the patient and the minimum dosing interval, and provided to the nurse attending the patient. While being transported, the medication tray 16 can be covered with a disposable cover.

A controller 30 (see FIG. 2) and its associated components control rotation of the medication tray 16 and allow patient access to the medications. In one embodiment the controller 30 is a microchip-based controller programmed to perform the various functions described herein. When the medication tray 16 is loaded into the device 10, the nursing or pharmacy staff enters the physician ordered dosing interval via an input device 34, comprising in one embodiment one or more manually operable switches. The controller 30 is responsive to the input device 34 for receiving and storing the dosing interval. The nursing staff also enters an authorization code, via the input device 34, that is stored in the controller 30, for later use to limit medication access to the patient for whom the medications are intended.

Although the description herein generally refers to a nursing staff as the party exercising control over the operation of the device 10, this function can be performed by any third party ultimately controlling the patient's medication dosing, such as an in-home care giver, medical technician, pharmacy staff member, physician, etc.

The controller 30 is further bidirectionally responsive to a timer 36 for monitoring the time interval between permitted doses, and to a door sensor 38 (see FIG. 1 for the physical location thereof) for determining the door position. From the door position information, the controller 30 determines the times when the door is opened and closed by the patient to receive the medication for self-administration. After the patient has sequenced the door through an open and close cycle to remove the medication dose, the controller 30 activates the timer 36 to begin a counting sequence representing the dosing interval. When the timer 36 times out, the dosing interval has elapsed and the patient is permitted to administer the next dose. In response thereto, the controller 30 illuminates an indicator 40 (see also FIG. 1) indicating that the dosing interval has elapsed. In one embodiment the indicator 40 comprises a light emitting diode. The embodiment illustrated in FIG. 1 includes a second indicator 41, not required for proper operation of the device 10, that is illuminated during the dosing interval, serving as an indication that the patient is not permitted to administer the next medication dose.

Returning to FIG. 1, note that the upper surface enclosure 17 further carries a keypad 42 comprising a plurality of user-operable keys for entering an authorization code. After the indicator 40 is illuminated, the patient uses the keypad 42 to enter a predetermined code that is supplied as an input to the controller 30. In one embodiment, the code comprises four digits and is followed by entry of an "enter" command on the keypad 42. If the entered code matches the stored authorized code, previously entered by the nursing staff as described above, in response thereto the controller 30 energizes a motor 44 to cause rotation of the medication tray 16, as described above, such that the next medication compartment 20 is aligned with the passage 18. The patient now has access to the next medication dose. In one embodiment the motor 44 comprises a stepping motor that when energized controllably rotates only through a predetermined number of turns such that the next medication tray 20 and the passage 18 are aligned.

The dosing timing cycle begins again when the door sensor 38 senses the opening and closing of the door, provides representative signals to the controller 30, and the controller 30 activates the timer 36.

If the patient's pain has subsided and he thus does not require a medication dose at the prescribed minimum interval, i.e., when the indicator 40 is illuminated, the patient can elect not to enter the prescribed authorization code. The device 10 remains in a ready condition such that whenever the code is entered the medication tray 16 is rotated and the next dose is accessible. Only an open and closing cycle of the door restarts the timing cycle.

Although the patient authorization process described above comprises the entry of numeric or alphabetic characters via the keypad 42, other identification techniques for determining if the patient is authorized to receive the medication can be employed, including fingerprint and voice print identification. Also a bar code reader can be incorporated into the medication on demand device 10 for reading a bar code assigned to the patient and printed on the patient's wristband. If the stored bar code in the reader matches the scanned bar code and the minimum dosing interval has elapsed, the medication tray 16 is rotated under control of the controller 30, as described above, to provide patient access to the next medication dose.

The door open and close times determined as described above, are stored within the controller 30 and displayable on a clock 48 (disposed on the bottom surface of the lower assembly 14) in response to command queries entered into the input device 34. Nursing staff can thus query the controller 30 to display the dose administration times, which can then be manually entered in the patient's chart. In another embodiment where patient records are stored in a computing mechanism and associated storage media, the controller 30 is connected via a wired or wireless network to the computing mechanism for automatically downloading these dose administration times and inputting them to the patient's record. Alternatively, the clock 48 is operable as a real time clock in response to commands entered into the input device 34 by nursing staff members.

Although the timer 36 is described herein as a separate component of the controlling mechanism of the device 10, those skilled in the art recognize that the timing function can be incorporated within the controller 30. Likewise, storage of the dosing interval, authorization code, etc., is described with reference to on-board storage in an internal memory within the controller 30. In another embodiment the device 10 includes external memory responsive to the controller 30 for storing program code and such data.

Figure 2:
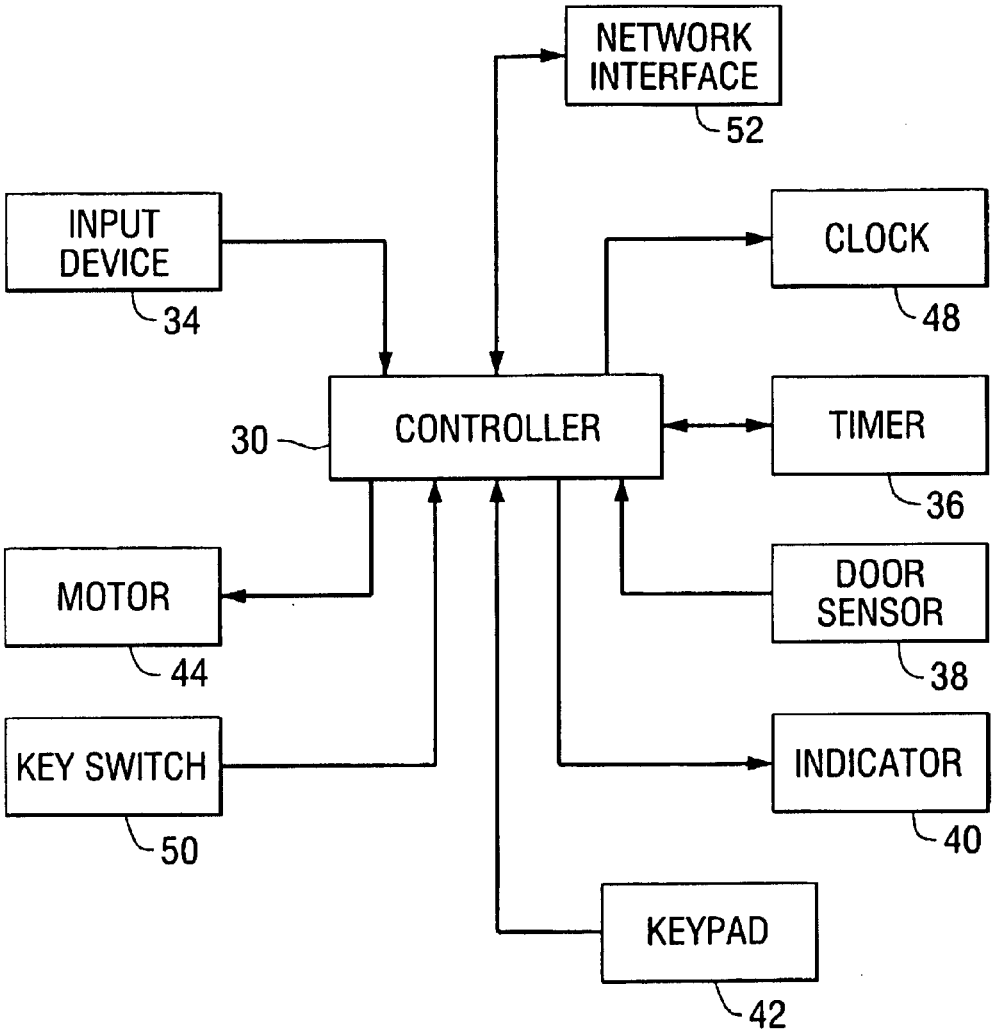
FIG. 2 is a block diagram of the control components of the medication on demand device of FIG. 1.

FIG. 2 further includes a key switch 50 for setting the operational mode for the device 10. In one embodiment the key switch 50 comprises a three-position key switch. A mating key is required to set the position of the key switch 50. Typically, this key would be accessible only to the nursing staff. In a first position the upper and lower assemblies 12 and 14 are separable for loading a new medication tray 16. Typically, the device 10 would be loaded with new medications doses every 24 hour period. Other time periods may apply depending on the dosing interval and the number of medication compartments 20. In a second position the device 10 is locked and ready for patient use. In a third position the dosing interval can be entered through the input device 34 and the controller 30 can be queried as to the times when the door 65 was opened and closed.

FIG. 2 further includes a network interface 52 providing a wired or wireless connection to a remote computing device. Various information collected by the controller 30, such as patient's dosing times and the minimum dosing interval, is supplied to the remote computing device via the network interface 52.

Figure 3:
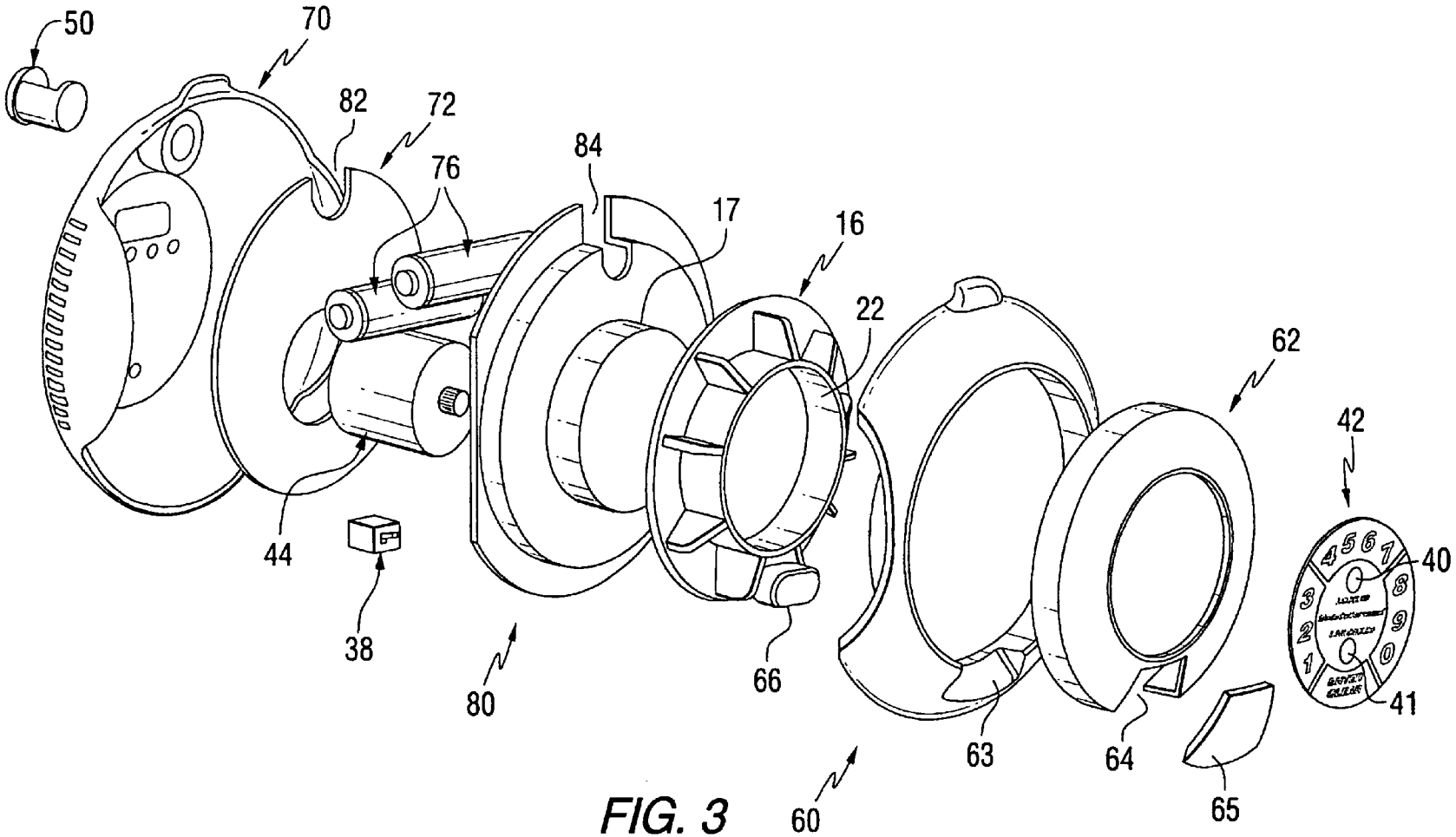
FIG. 3 is another exploded view of a medication on demand device constructed according to the teachings of the present invention.

A more detailed exploded view of the medication on demand device 10 is illustrated in FIG. 3, wherein the upper assembly 12 comprises a housing 60, for receiving a cover 62. A first portion 63 of the passage 18 is formed within the housing 60 and a second portion 64 thereof is formed within the cover 62. A door 65 provides access to the passage 18.

The lower assembly 14 further comprises a housing 70 carrying a circuit board 72 on which the controller 30 (not shown in FIG. 3) and its associated components are mounted. The motor 44, powered by batteries 76, is mounted within a housing 80. The key switch 50 passes through a notch 82 in the circuit board 72 and a notch 84 in the housing 80. The key switch 50 is electrically connected to the controller 30.

Figure 4:
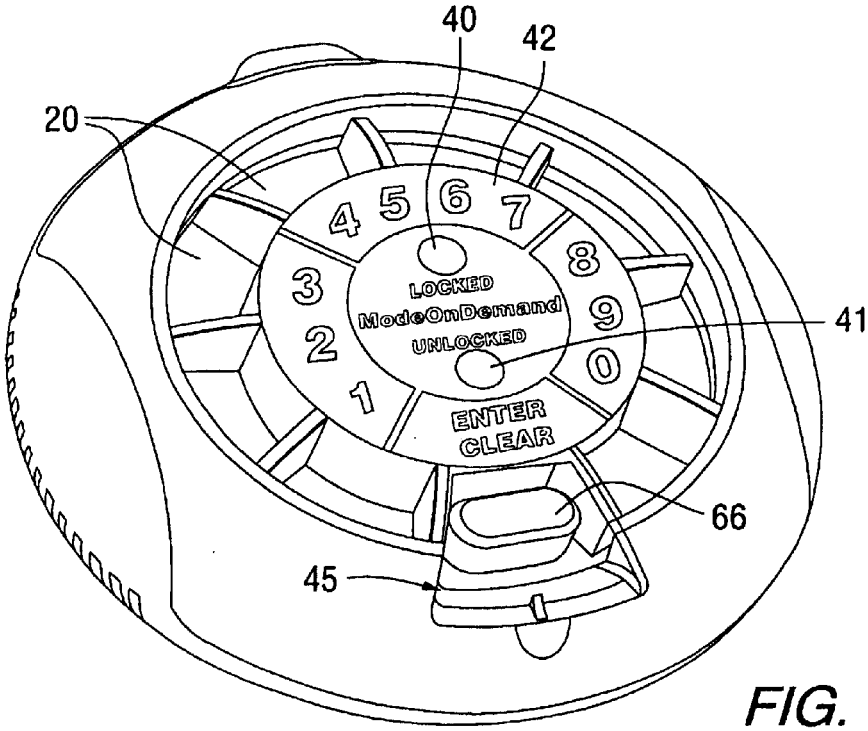
FIGS. 4 and 5 are top and bottom views, respectively, of the medication on demand device of FIGS. 1 and 2.

FIG. 4 is a top view of the medication on demand device 10 illustrating the previously discussed components.

Figure 5:
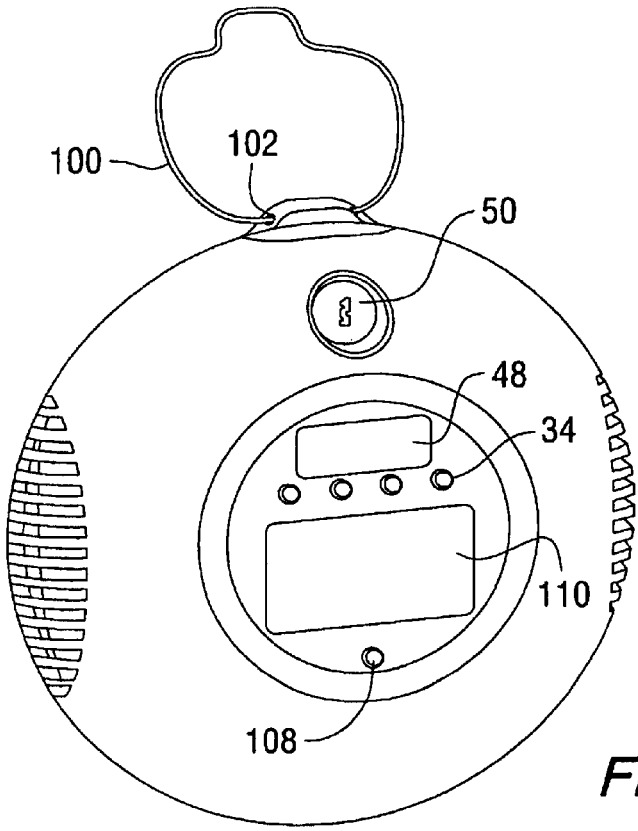

FIG. 5 is a bottom view of the medication on demand device 10 illustrating several of the previously described components of the device 10. A guide wire 100 for securing the medication on demand device 10 to a patient's bed, bedside table or tray passes through a loop hole 102. The input device 34 and the clock 48 are also shown in the bottom view of FIG. 5.

The bottom surface of the device 10 further includes a low-battery indicator 108 and a recess 110 for receiving, for example, patient identification information, the medication type and dosage, and the minimum interval between doses. Typically, this information is recorded on adhesive-backed material received within the recess 110. The device 10 includes a stacking ring 112 for mating with a receiving recess in the upper assembly 12 of a second device 10, thus allowing several devices 10 to be transported and stored in an efficient and stable configuration.

Figure 6:
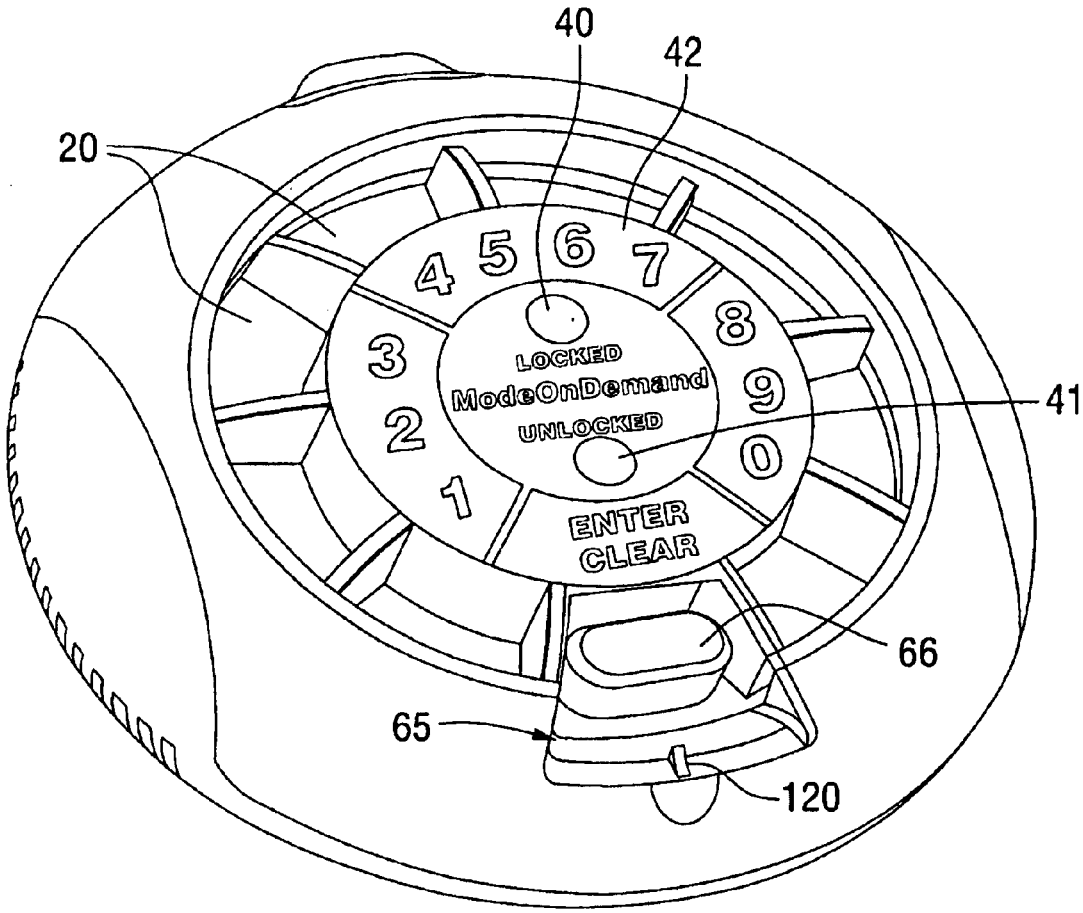
FIG. 6 is a top view of another embodiment of the medication on demand device.

In another embodiment of the present invention, the door 65 is lockable and controllable by operation of the controller 30, such that a door lock 120 in FIG. 6 is released only after the minimum dosing interval has elapsed. In this embodiment, rotation of the medication tray 16 by operation of the motor 44 under control of the controller 30 can occur at any time during the dosing interval, as the patient cannot gain access to the medication until the door 65 is unlocked.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt the teachings of the present invention to a particular application without departing from its essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A medication dispenser for permitting administration of an as-needed medication dose to a patient at a predetermined minimum dosing interval, said medication dispenser comprising:

a medication tray carrying a plurality of medication doses;

a housing enclosing said medication tray, wherein said housing includes a passage providing access to a medication dose, wherein said medication dose is accessed through a door in the housing, and wherein the door is controllable to an openable position; and a controller for permitting access to a medication dose through said passage only after the minimum dosing interval has elapsed from an immediately previous patient's open/close door cycle to remove a previously administered medication, and wherein a medication-carrying compartment of the medication tray is rotated into alignment with said passage after the minimum dosing interval has elapsed, and wherein said door is controlled to said openable position upon identification of the patient as the person for whom the medication is intended.

2. The medication dispenser of claim 1 wherein the medication tray comprises a circularly shaped tray having a plurality of medication carrying compartments situated around the periphery thereof.

3. The medication dispenser of claim 1 wherein patient identification information is stored within the controller, and wherein the patient is identified by comparing the stored patient identification information with identification indicia provided by the patient.

4. The medication dispenser of claim 3 wherein the medication dispenser further comprises a keypad, and wherein the identification indicia provided by the patient comprises entry of character information on said keypad, and wherein the controller is responsive to the character information for permitting access to the medication dose.

5. The medication dispenser of claim 1 wherein the controller moves the medication tray relative to the passage, to allow patient access to the next medication dose through the passage in response to the expiration of the minimum dosing interval and further in response to identification of the patient as the person for whom the medication is intended.

6. The medication dispenser of claim 5 wherein patient identification information is stored within the controller, and wherein the patient is identified as the person for whom the medication is intended by comparing the stored patient identification information with identification indicia provided by the patient.

7. The medication device of claim 1 wherein the controller determines when the patient has accessed a medication dose through the passage.

8. The medication dispenser of claim 7 further comprising a door position sensor for determining the position of the door, wherein the controller determines when the patient has accessed a medication dose in response to the door position sensor.

9. The medication dispenser of claim 8 further comprising a clock controllable by the controller for displaying the time when the patient accessed a medication dose through the passage.

10. The medication dispenser of claim 1 further comprising an input device for receiving a manually entered code representing the minimum dosing interval, wherein the controller is responsive to the manually entered code for permitting access to a medication dose through the passage only after the minimum dosing interval has elapsed.

11. The medication dispenser of claim 1 further comprising a key switch having a plurality of positions, wherein the controller is responsive to said key switch for controlling the operational mode of the medication dispenser.

12. The medication dispenser of claim 11 wherein a first position of the key switch opens the housing to provide access to the medication tray, and wherein a second position activates normal operation of the device for permitting patient access to a medication dose, and wherein a third position permits entry of the minimum dosing interval, and wherein the controller is responsive to the entered minimum dosing interval.

13. The medication dispenser of claim 1 further comprising an indicator for indicating when the minimum dosing interval has elapsed.

14. The medication dispenser of claim 13 wherein when the indicator indicates that the minimum dosing interval has elapsed, the patient provides authorization indicia indicating that the patient is authorized to gain access to the medication dose.

15. The medication dispenser of claim 14 wherein the controller moves the medication tray relative to the passage, to allow patient access to the next medication dose through the passage in response to the expiration of the minimum dosing interval and further in response to identification of the patient as the person for whom the medication is intended.

16. The medication dispenser of claim 1 further comprising a network interface for providing dosing information to a remote computing device.

17. A medication dispenser for permitting administration of an as-needed medication dose to a patient at a predetermined minimum dosing interval, said medication dispenser comprising:

a medication tray carrying a plurality of medication doses;

a controlled access passage to the plurality of medication doses, wherein said controlled access passage is controllable to a dose-accessible position; and a controller for controlling said controlled access passage to permit access to a medication dose only after the minimum dosing interval has elapsed from a patient's immediately previous dose removal, and wherein a medication-carrying compartment of the medication tray is aligned with said controlled access passage after the minimum dosing interval has elapsed, and wherein said controlled access passage is controlled to said dose-accessible position upon identification of the patient as the person for whom the medication is intended.

* * * * *